US007296547B2

(12) United States Patent
Ottersbach et al.

(10) Patent No.: US 7,296,547 B2
(45) Date of Patent: Nov. 20, 2007

(54) DEVICE FOR ADJUSTING THE CAMSHAFT OF AN INTERNAL COMBUSTION ENGINE AND A MOUNTING TOOL

(75) Inventors: Rainer Ottersbach, Aurachtal (DE); Rudolf Eydam, Geisfeld (DE)

(73) Assignee: Ina-Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/256,338

(22) Filed: Oct. 21, 2005

(65) Prior Publication Data

US 2006/0086331 A1 Apr. 27, 2006

(30) Foreign Application Priority Data

Oct. 22, 2004 (DE) ..... 10 2004 051 424

(51) Int. Cl.
*F01L 1/34* (2006.01)

(52) U.S. Cl. ..... 123/90.17; 123/90.15; 123/90.31

(58) Field of Classification Search ..... 123/90.15, 123/90.16, 90.17, 90.18, 90.31, 90.27; 464/1, 464/2, 160

See application file for complete search history.

(56) References Cited

U.S. PATENT DOCUMENTS 5,592,910 A * 1/1997 Suga et al. ..... 123/90.17
5,882,181 A * 3/1999 Genter et al. ..... 417/364
6,439,180 B2 * 8/2002 Groeger et al. ..... 123/90.17
6,843,215 B2 * 1/2005 Hiratsuka et al. ..... 123/90.17
2003/0070639 A1 * 4/2003 Kohrs

FOREIGN PATENT DOCUMENTS

DE 19612 397 Y 10/1997
DE 197 09 6556 Y 9/1998
DE 198 27 860 A 12/1999
DE 10 2004 035 077 E 2/2006
WO WO 2004057163 A1 * 7/2004

* cited by examiner

*Primary Examiner*—Ching Chang
(74) *Attorney, Agent, or Firm*—Lucas & Mercanti, LLP

(57) ABSTRACT

The invention relates to a device (1) for adjusting the camshaft of an internal combustion engine, which has an internal rotor (2) which can be adjusted rotationally in relation to an external rotor (3), with the internal rotor (2) being secured to a camshaft (5) by means of a central screw (4). In order to permit improved mounting of the device it is provided according to the invention for the internal rotor (2) and/or the external rotor (3) to have at least one recess (6, 7) for the engagement of a mounting tool (8, 9) by means of which the internal rotor (2) and the external rotor (3) can be secured fixed in terms of rotation. Furthermore, the invention relates to a mounting tool for mounting such a device.

14 Claims, 2 Drawing Sheets

DEVICE FOR ADJUSTING THE CAMSHAFT OF AN INTERNAL COMBUSTION ENGINE AND A MOUNTING TOOL

FIELD OF THE INVENTION

The invention relates to a device for adjusting the camshaft of an internal combustion engine, which has an internal rotor which can be adjusted rotationally in relation to an external rotor, with the internal rotor being secured to a camshaft by means of a central screw. Furthermore, the invention relates to a mounting tool for mounting such a device.

Camshaft adjustment devices of this type are sufficiently known in the prior art. For example, in DE 198 08 618 A1, in DE 199 51 391 A1 and in DE 102 53 496 A1 solutions are described in which an internal rotor is screwed to the camshaft of the internal combustion engine by means of a central screw. The external rotor is operatively connected to the crankshaft via a chain or via a toothed belt. A relative rotational movement can be induced between the internal rotor and external rotor under the control of an external hydraulic application means. For this purpose, the internal rotor is embodied, for example, as an impeller wheel in which blades are formed or arranged. The blades are located in hydraulic chambers which are formed in the external rotor. By correspondingly acting on the respective side of the hydraulic chambers it is possible to adjust the internal rotor in relation to the external rotor between an "early stop" and a "late stop".

Occasionally the mounting of the device is problematic in this context: the internal rotor must be secured to the camshaft in a rotationally fixed fashion by means of the central screw. For this purpose, the screw has to be tightened with a predefined torque; it is screwed into the threaded bore in the camshaft which extends in the axial direction of the camshaft. In this context, the tightening torque is applied to the screw at its key face. The opposing torque is taken up on a key face on the camshaft. By tightening the screw, the internal rotor on the camshaft is rotationally fixed. In this context, the entire loading of the tightening torque is inevitably transmitted to the camshaft. As a result, the friction torque between the central screw head and the internal rotor is also transmitted to the clamping face between the internal rotor and camshaft, which can lead to slipping. This in turn leads to a situation in which the relative position between the internal rotor and camshaft changes, which causes a control time error which can have serious consequences.

In order to remedy this it is basically possible to position under the central screw a washer which has a key face (for example hexagonal washer) in which a mounting tool can engage. As a result, when the central screw is tightened the opposing torque can be largely taken up via the washer—only the frictional torque in the thread has to be taken up via a key face on the camshaft—so that there is no risk of twisting of the internal rotor in relation to the camshaft. However it is disadvantageous here that an additional component is necessary (washer) which both entails additional costs and increases the axial installation space of the camshaft adjustment device.

Finally, it is basically possible for the opposing torque to be applied to the external rotor of the camshaft adjuster when the central screw is tightened, for which purpose key faces can be provided on said camshaft adjuster. The tightening torque acting in the thread of the camshaft can be applied by means of key faces formed on the camshaft. As a result, the external rotor is loaded with a considerable torque, which is disadvantageous for the internal components of the camshaft adjuster. Considerable forces are applied to the blades or locking pins here since the tightening torque for the central screw is high compared to the operating torque.

The present invention is therefore based on the object of developing a camshaft adjuster of the type mentioned at the beginning in such a way that the aforesaid disadvantages are avoided. It is also to be possible to tighten firmly the central screw which connects the internal rotor to the camshaft without high torque loading occurring between the individual components of the camshaft adjuster or between the internal rotor and camshaft. The intention here is to make possible a lightweight design of the camshaft adjuster, i.e. one dimensioning process on the operating torque of the camshaft adjuster is to be sufficient. In addition, there is to be no risk of a control time error occurring when the adjuster is mounted.

The means of achieving this object by virtue of the invention is characterized in that the internal rotor and/or the external rotor has at least one recess for the engagement of a mounting tool, via which recess the internal rotor and the external rotor can be secured fixed in terms of rotation.

This ensures that the torque opposing the tightening torque of the central screw is taken up directly on the internal rotor or on the external rotor so that in particular the connection between the internal rotor and camshaft is not loaded with a torque or only with a small torque. As a result, a relatively lightweight design of the camshaft adjuster is possible. Control time errors owing to the transmission of the tightening torque from the internal rotor to the camshaft are prevented.

The recess for the engagement of the mounting tool is preferably produced on the internal rotor on a bore formed concentrically with respect to the rotational axis of the internal rotor. The recess can also be produced on the external rotor on an external circumferential face formed concentrically with respect to the rotational axis of the external rotor.

The recess is preferably embodied as a radially extending groove. It can extend in the axial direction over part of the axial extent of the bore in the internal rotor. In this context, the recess may extend from an internal diameter to an external diameter on the internal rotor or on the external rotor.

An improved fit of the mounting tool is obtained if the recess has a base region which is set back in the axial direction. The base region may be continuous here with a tool fitting region which is not arranged set back.

Three recesses which are distributed over the circumference and in which the mounting tool can engage are preferably formed in the internal rotor or in the external rotor. In order to be able to apply the tool in just one position, it may also be provided that the three recesses are arranged distributed non-uniformly over the circumference of the internal rotor or of the external rotor.

In terms of fabrication equipment it has proven valuable if the at least one recess is formed in the internal rotor or in the external rotor by means of a shaping process or a non-metal-cutting fabrication process.

Sintered metal, for example sintered iron with alloy elements, or else a non-metallic material, may be used as the material for the internal rotor, and the internal rotor can also be composed only partially of the aforesaid materials.

The mounting tool according to the invention for mounting the camshaft adjuster has a hollow cylindrical section on which at least one correspondingly constructed projection is arranged in order to engage in the at least one recess. Good handling of the tool is obtained if a radially extending gripping arm is arranged on the hollow cylindrical section, preferably being welded to it.

BRIEF DESCRIPTION OF THE DRAWINGS

An exemplary embodiment of the invention is illustrated in the drawings, in which.

DETAILED DESCRIPTION OF THE DRAWINGS

Figure 1:
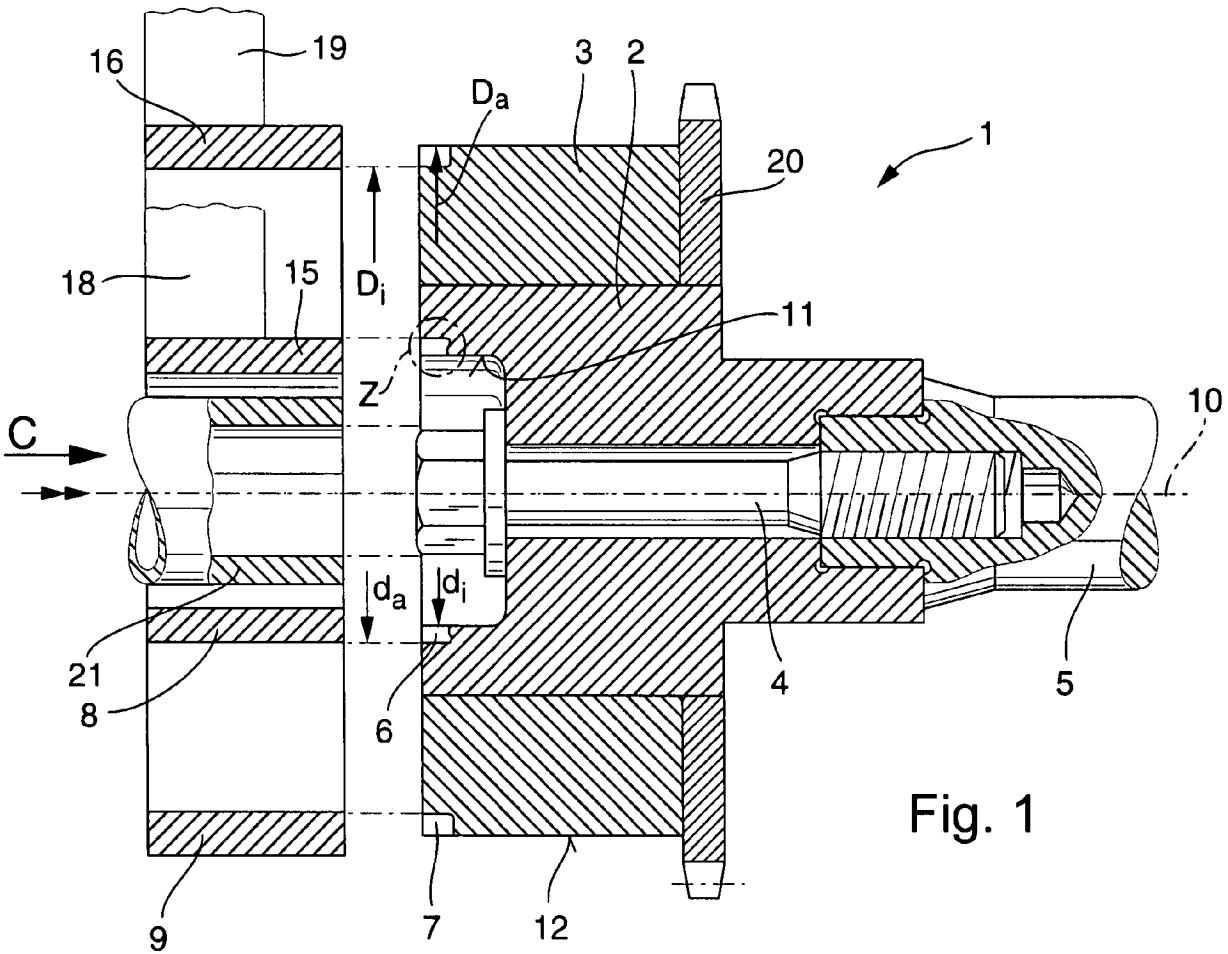
FIG. 1 shows a partially only very schematically illustrated device for camshaft adjustment of an internal combustion engine together with mounting tools in a section (section A-B according to FIG. 3)

FIG. 1 shows a camshaft adjuster 1 in which an internal rotor 2 and an external rotor 3 are outlined only very schematically, which internal rotor 2 and external rotor 3 can be set with respect to one another between two end positions by means of a hydraulic adjustment mechanism (not illustrated). By way of example, reference is made to DE 101 35 146 A1 where the customary method of operation of a hydraulic camshaft adjuster is explained.

An operative connection between the crankshaft of the internal combustion engine and the drive gear wheel 20 is brought about by means of a chain (not illustrated), said drive gear wheel 20 being connected fixed in terms of rotation to the external rotor 3. The adjustment mechanism (not illustrated) brings about a relative rotational position between the external rotor 3 and internal rotor 2. The internal rotor 2 is screwed to the camshaft 5 of the internal combustion engine by means of a central screw 4 so as to be fixed in terms of rotation. The internal rotor 2 has a bore 11 which is formed concentrically with respect to the rotational axis 10 of the crankshaft 5 and in whose center the central screw 4 is arranged.

So that a high torque does not need to be transmitted from the internal rotor 2 to the camshaft 5 when the central screw 4 is tightened on the camshaft 5 with a relatively high torque—which can lead to undesired twisting and thus to control time faults—recesses 6 (which are illustrated in detail in FIGS. 2 and 3) are provided in the bore 11 in the axial edge region of the internal rotor 2. In accordance with this the recesses 6 are configured in the form of grooves, in which case they extend from the internal diameter $d_i$ of the bore to an external diameter $d_a$. The axial extent of the recesses 6 is given by h in FIG. 2; viewed together with FIG. 1 it is apparent that the extent h only makes up part of the entire depth of the bore. FIG. 3 shows that three recesses 6 are provided in the internal rotor 2, said recesses 6 being arranged distributed non-uniformly over the circumference. Two recesses 6 lie diametrically opposite one another in the bore 11, while the third recess 6 is arranged between them. This ensures that the tool which is constructed so as to be complementary with respect to the recesses 6 can be fitted in only one position on the internal rotor 2.

Figure 2:
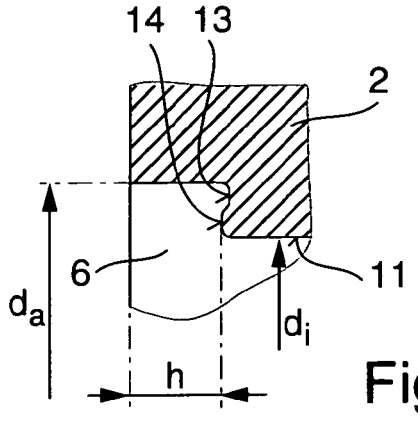
FIG. 2 shows the detail "Z" according to FIG. 1.
Figure 3:
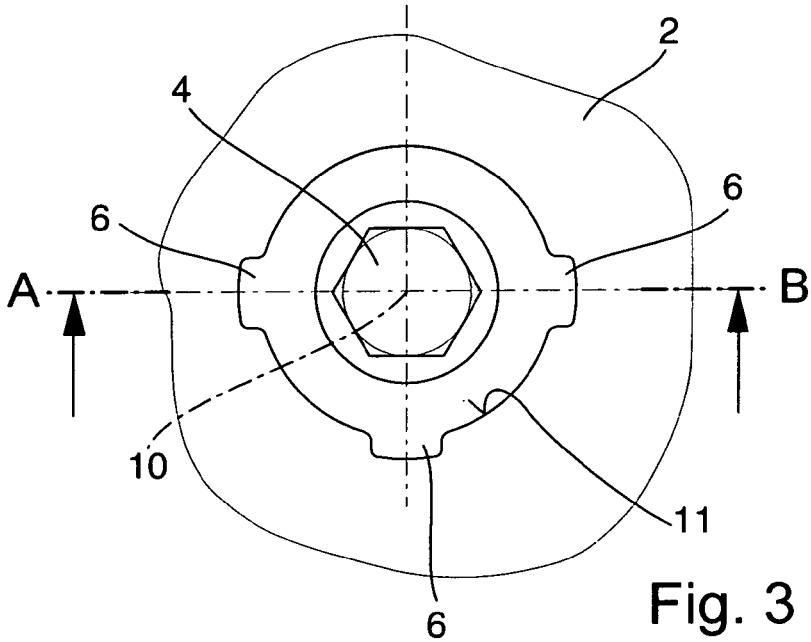
FIG. 3 shows the view "C" according to FIG. 1 without mounting tools and only for the internal part of the device.

FIG. 2 also shows that the recess 6 has a base region 13 which is arranged axially set back with respect to a tool fitting region 14. This permits the mounting tool to be fitted precisely.

Corresponding to the recesses 6 on the internal rotor 2, recesses 7 are arranged on the external rotor 3 and are embodied in an analogous fashion. Here, the recesses extend from an internal diameter $D_i$ (see FIG. 1) to an external diameter $D_a$ which is at the height of the external circumferential face 12 of the external rotor 3.

Figure 4:
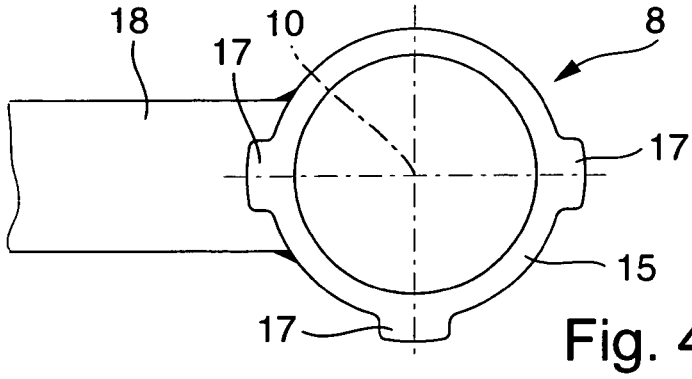
FIG. 4 shows the view "C" according to FIG. 1 of the mounting tool engaging in the internal rotor.

The mounting tool 8 which is used for mounting the internal rotor 2 on the camshaft 5, for the purpose of engagement in the recesses 6 in the internal rotor 2, is outlined in FIG. 4. Said mounting tool 8 has, on a hollow cylindrical section 15, three integrally formed-on projections 17 which correspond to the shape of the recesses 6. A gripping arm 18 permits the mounting tool 8 to be secured with a corresponding lever when the central screw 4 is tightened.

The mounting tool 9 which is used for engagement in the external rotor 3 is of corresponding design to the mounting tool 8.

FIG. 1 shows how the mounting tools 8 and 9 are fitted onto the camshaft adjuster 1 in order to tighten the central screw 4. The mounting tools 8 and 9 are outlined here in a position in which they have been pulled off the camshaft adjuster 1. The mounting tool 8 engages with its projections 17 (see FIG. 4) in the recesses 6, which prevents the internal rotor 2 from being rotated by tightening the gripping arm 18. In a corresponding way, the mounting tool 9 engages with its projections (not illustrated) arranged on the hollow cylindrical section 16 in the recesses 7 in the external rotor 3, as a result of which the external rotor 3 can be prevented from rotating by tightening the gripping arm 19. After this, the central screw 4 can be tightened by means of a tightening nut 21 without any appreciable torque having to be applied to the camshaft 5.

LIST OF REFERENCE SYMBOLS

1 Device for adjusting a camshaft
2 Internal rotor
3 External rotor
4 Central screw
5 Camshaft
6 Recess
7 Recess
8 Mounting tool
9 Mounting tool
10 Rotational axis
11 Bore
12 External circumferential face
13 Base region
14 Tool fitting region
15 Hollow cylindrical section
16 Hollow cylindrical section
17 Projection
18 Gripping arm
19 Gripping arm
20 Drive gear wheel
21 Tightening nut
h Axial extent of the recess
$d_i$ Internal diameter
$d_a$ External diameter
$D_i$ Internal diameter
$D_a$ External diameter

The invention claimed is:

1. A device for adjusting a camshaft of an internal combustion engine, comprising:

an internal rotor and an external rotor, said internal rotor being adjusted rotationally in relation to an external rotor, with the internal rotor being secured to a camshaft by means of a central screw, wherein the internal rotor and/or the external rotor has at least one recess for the engagement of a mounting tool such that the internal rotor and the external rotor can be securely fixed in terms of rotation, wherein the recess is produced on the internal rotor on a bore formed concentrically with respect to the rotational axis of the internal rotor, and wherein the recess is produced on the external rotor on an external circumferential face formed concentrically with respect to the rotational axis of the external rotor.

2. The device according to claim 1, characterized in that the at least one recess is embodied as a radially extending groove.

3. The device according to claim 1, characterized in that the recess produced on the internal rotor extends in the axial direction over part (h) of the axial extent of the bore.

4. The device according to claim 1, characterized in that the at least one recess produced on the internal rotor extends from an internal diameter ($d_i$) to an external diameter ($d_a$) on the internal rotor or from an internal diameter ($D_i$) to an external diameter ($D_a$) on the external rotor.

5. The device according to claim 1, characterized in that the at least one recess has a base region which is set back in the axial direction.

6. The device according to claim 5, characterized in that the base region is continuous with a tool fitting region which is not arranged set back.

7. The device according to claim 1, characterized in that three recesses are distributed over a circumference of the internal rotor or of the external rotor.

8. The device according to claim 7, characterized in that the three recesses are arranged distributed non-uniformly over the circumference of the internal rotor or of the external rotor.

9. The device according to claim 1, characterized in that the at least one recess is formed in the internal rotor or external rotor by means of a shaping process.

10. The device according to claim 1, characterized in that the internal rotor is composed at least partially of sintered metal.

11. The device according to claim 1, characterized in that the internal rotor is composed at least partially of non-metallic material.

12. A mounting tool for mounting the device according to claim 1, comprising:

a hollow cylindrical section on which at least one correspondingly constructed projection is arranged in order to engage in the at least one recess.

13. The mounting tool according to claim 12, further comprising a radially extending gripping arm arranged on the hollow cylindrical section.

14. The mounting tool according to claim 13, wherein the gripping arm is welded to the hollow cylindrical section.

* * * * *